US011145473B2

(12) United States Patent
Corna et al.

(10) Patent No.: US 11,145,473 B2
(45) **Date of Patent: *Oct. 12, 2021**

(54) BREAKER FOR HIGH D.C. CURRENT OR VOLTAGE APPLICATIONS, FOR INSTANCE INDUSTRIAL AND/OR RAILWAYS APPLICATIONS

(71) Applicant: MICROELETTRICA SCIENTIFICA S.P.A., Buccinasco (IT)

(72) Inventors: Marco Corna, Almenno San Salvatore (IT); Lorenzo Stendardi, Milan (IT); Claudio Mondellini, Treviglio (IT)

(73) Assignee: MICROELECTRICA SCIENTIFICA S.P.A.

( * ) Notice: Subject to any disclaimer, the term of this patent is extended or adjusted under 35 U.S.C. 154(b) by 64 days.

This patent is subject to a terminal disclaimer.

(21) Appl. No.: 16/604,838

(22) PCT Filed: Apr. 9, 2018

(86) PCT No.: PCT/EP2018/000171
§ 371 (c)(1),
(2) Date: Oct. 11, 2019

(87) PCT Pub. No.: WO2018/188781
PCT Pub. Date: Oct. 18, 2018

(65) Prior Publication Data

US 2021/0125797 A1 Apr. 29, 2021

(30) Foreign Application Priority Data

Apr. 11, 2017 (EP) ..... 17165967

(51) Int. Cl.
*H01H 9/36* (2006.01)
*H01H 9/34* (2006.01)
(Continued)

(52) U.S. Cl.
CPC ..... *H01H 9/362* (2013.01); *H01H 9/345* (2013.01); *H01H 33/596* (2013.01); *H01H 71/10* (2013.01); *H01H 73/18* (2013.01)

(58) Field of Classification Search
CPC ..... H01H 3/28; H01H 9/362; H01H 9/345; H01H 9/46; H01H 9/443; H01H 33/596;
(Continued)

(56) References Cited

U.S. PATENT DOCUMENTS 2,904,659 A * 9/1959 Boehne ..... H02B 11/167 218/22
3,992,599 A 11/1976 Halbach
(Continued)

FOREIGN PATENT DOCUMENTS

CN 102187416 A 9/2011
CN 202796810 U 3/2013
(Continued)

OTHER PUBLICATIONS

International Search Report & Written Opinion corresponding to PCT/EP2018/000171 dated Aug. 10, 2018.

*Primary Examiner* — William A Bolton
(74) *Attorney, Agent, or Firm* — Barnes & Thornburg LLP

(57) ABSTRACT

An improved breaker for high current or voltage applications, for instance industrial and/or railways applications, is provided wherein a high current must be switched on/off or interrupted with high efficiency and extremely fast intervention times. The breaker may include a base portion including an activating mechanism including a holding mechanism and a release mechanism, an intermediate switching or breaking contact portion, including fixed contacts and mov-
(Continued)

able contacts, and a top arc chute extinguishing portion covering the intermediate switching or breaking contact portion.

14 Claims, 8 Drawing Sheets

(51) Int. Cl.
*H01H 33/59* (2006.01)
*H01H 71/10* (2006.01)
*H01H 73/18* (2006.01)

(58) Field of Classification Search
CPC ..... H01H 33/50; H01H 71/10; H01H 71/12; H01H 71/66; H01H 71/68; H01H 71/24; H01H 71/2409; H01H 71/2436; H01H 2071/665
USPC ..... 218/151–156, 158, 15, 22, 23, 104; 200/441
See application file for complete search history.

(56) References Cited

U.S. PATENT DOCUMENTS 4,388,506 A * 6/1983 Murai ..... H01H 9/345 200/304
4,764,650 A * 8/1988 Bur ..... H01H 73/18 200/281
7,417,520 B2 * 8/2008 Kralik ..... H01H 9/34 200/10
7,566,840 B2 * 7/2009 Sudhakar ..... H01H 77/104 200/244
2013/0106876 A1 * 5/2013 Lee ..... G09G 5/18 345/520
2016/0329177 A1 * 11/2016 Ignatov ..... H01H 33/182

FOREIGN PATENT DOCUMENTS

CN 105659344 A 6/2016
WO 2009065705 A1 5/2009

* cited by examiner

BREAKER FOR HIGH D.C. CURRENT OR VOLTAGE APPLICATIONS, FOR INSTANCE INDUSTRIAL AND/OR RAILWAYS APPLICATIONS

CROSS REFERENCE AND PRIORITY CLAIM

This patent application is a U.S. National Phase of International Patent Application No. PCT/EP2018/000171 filed Apr. 9, 2018, which claims priority to European Patent Application No. 17165967.5 filed Apr. 11, 2017, the disclosures of which are incorporated herein by reference in their entirety.

FIELD

Disclosed embodiments relate to an improved breaker for industrial and railways applications.

More specifically, but not exclusively, the disclosed embodiments relate to a breaker for industrial and/or railways applications wherein, for instance, a high D.C. current must be switched on and off with high frequencies switching actions or must be interrupted with high efficiency and extremely fast intervention times.

BACKGROUND

As it is well known in this specific technical filed, a contactor is a remote control switch with an electromagnetic actuator that may be used in industrial or railways applications wherein a high D.C. current must be switched on and off with relatively high frequencies switching actions.

Generally speaking a contactor may be considered a breaker for high current and voltage applications.

Just to give an idea of the working conditions and the range of current values involved for these kind of contactors, it should be noted that these devices must be able to efficiently switch currents at least in the range between 400 A to 1800 A and under operating voltage ranges between 1000 V and 4000 V.

Those operating ranges may even be referred to a single pole of the contactor but in many application it is however necessary to provide a double or a three poles configuration.

A contactor of known structure normally includes fixed contacts, movable contacts and at least a contactor coil. As soon as a sufficient starting current flows through the contactor coil, the contactor responds and turns on the loads connected in the load circuit.

SUMMARY

Disclosed embodiments provide an arc chute portion that is structurally different according to the different voltage ranges that must be treated and the corresponding arc chute type and energy capacity that shall be extinguished in total security.

Accordingly, disclosed embodiments provide an improved breaker for high current or voltage applications, for instance industrial and/or railways applications, wherein a high current must be switched on/off or interrupted with high efficiency and extremely fast intervention times.

In accordance with at least some disclosed embodiments, a breaker may include, in a casing, a base portion including an activating mechanism for switching means including a holding mechanism and a release mechanism, an intermediate switching or breaking contacts portion, including fixed contacts and movable contacts, and a top arc chute extinguishing portion covering the intermediate switching or breaking contact portion, wherein the arc chute extinguishing portion is moveable with respect to the switching or breaking contact portion and is provided with external polar expansions that are coupled on both main sides of the breaker, and wherein further polar expansions being electrically coupled to the external polar expansion and linked to the intermediate switching portion as fixed part of the breaker.

BRIEF DESCRIPTION OF THE FIGURES

Further features and advantages of the contactor device of disclosed embodiments will appear from the following description given by way of non limiting example with reference to the enclosed drawings Figures.

DETAILED DESCRIPTION

Figure 1:
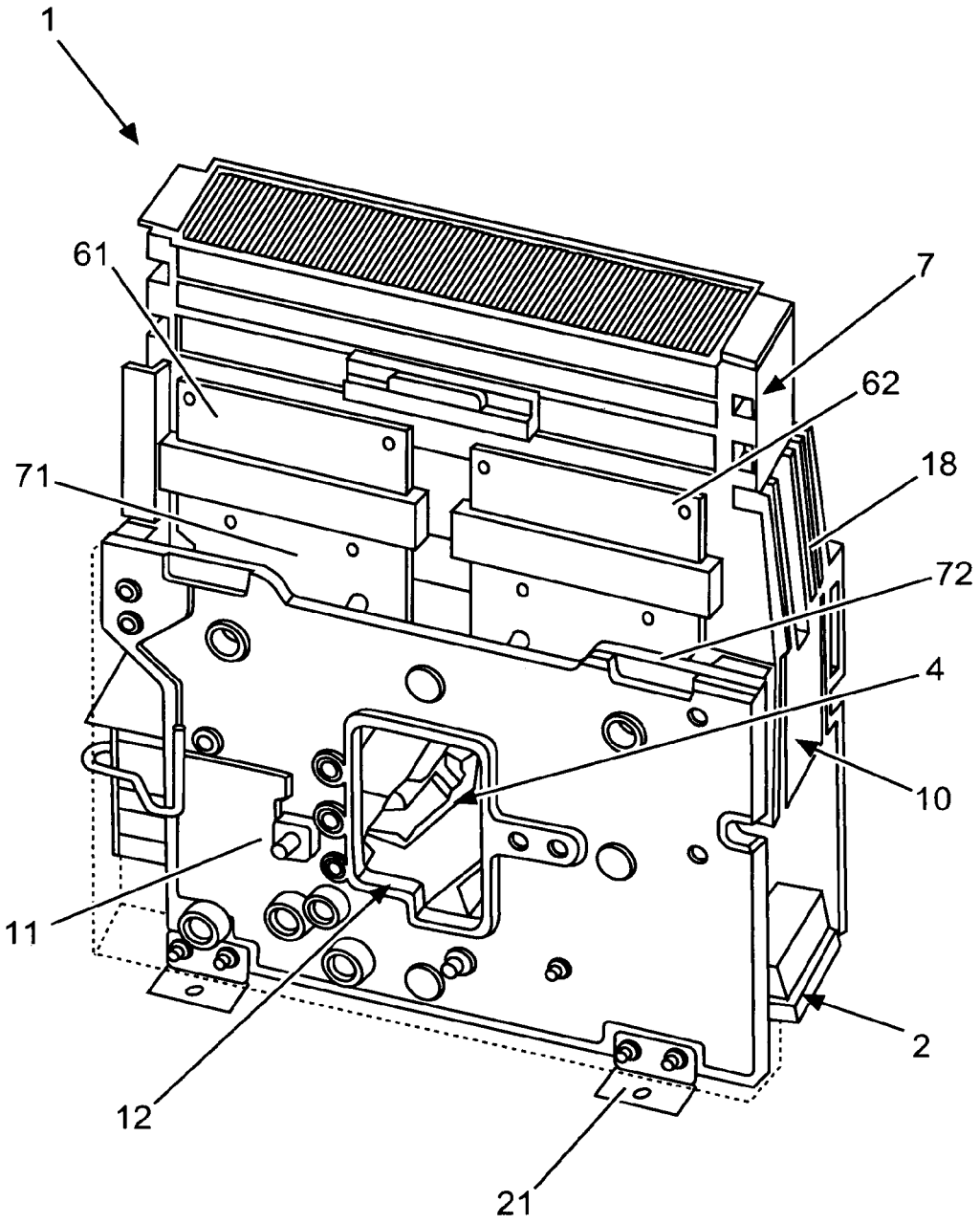
FIG. 1 shows a schematic and perspective view of a breaker realized according to disclosed embodiments.

To maintain a contactor in an operating state, a holding current must continuously flow through the contactor. After the holding current is switched off, the contactor drops out. The energy stored in the contactor coil is dissipated in a free-wheeling circuit.

Similarly, even a high speed current breaker may be considered a breaker for high current and voltage applications.

A current breaker is an automatically operated electrical switch designed to protect an electrical circuit from damage caused by over-current or overload or short circuit. Its basic function is to interrupt current flow after protective relays detect a fault.

These breakers are used in various applications to protect equipment against short-circuit currents and overloads; for instance, they are suitable for protection of mains and semiconductors (converters/rectifiers) in railway and industrial applications.

Feeder circuit breakers and rectifier circuit breakers are available on the market with operating currents up to 8,000 ADC and operating voltages up to 4,400 VDC. They have a very high interruption capacity combined with a current limiting characteristic.

Generally speaking, for obtaining the above mentioned superior circuit breaking capacity and an outstanding dielectric performance it is necessary to employ high quality materials to ensure service continuity and protection during adverse system events.

Both contactors and breakers require an arc extinguishing portion, so-called arc chute portion, for properly dissipating the electric arc that may be generated in the high voltage portion of the switch where the movable contacts are provided.

One of the main problems encountered in the manufacturing of the breakers for high current and voltage applications is the correct dimensioning of the arc extinguishing portion.

This design phase is particularly critical since the arc chute portion requires sometimes to be enlarged and expanded according to the version of the breaker, that is to say, according to the operating current or voltage that the breaker must manage.

The technical problem underlining the disclosed embodiments is the need to provide an improved breaker for high current or high voltage switching or breaking applications having structural and functional characteristics to allow a more efficient dissipation of the electric arc that may be generated during the opening or closure phase of the movable contacts.

Disclosed embodiments may provide a breaker having a higher reliability and a longer operating life due to a higher efficiency in the dissipation phase of the possible electric arc.

Disclosed embodiments may provide a breaker that may be constructed with materials having reasonable industrial costs.

Disclosed embodiments may provide an arc chute portion that is structurally different according to the different voltage ranges that must be treated and the corresponding arc chute type and energy capacity that shall be extinguished in total security.

Accordingly, disclosed embodiments may provide an improved breaker for high current or voltage applications, for instance industrial and/or railways applications, wherein a high current must be switched on/off or interrupted with high efficiency and extremely fast intervention times.

In accordance with at least some disclosed embodiments, a breaker may include, in a casing, a base portion including an activating mechanism for switching means including a holding mechanism and a release mechanism, an intermediate switching or breaking contacts portion, including fixed contacts and movable contacts, and a top arc chute extinguishing portion covering the intermediate switching or breaking contact portion, wherein the arc chute extinguishing portion is moveable with respect to the switching or breaking contact portion and is provided with external polar expansions that are coupled on both main sides of the breaker, and wherein further polar expansions being electrically coupled to the external polar expansion and linked to the intermediate switching portion as fixed part of the breaker.

In accordance with at least some disclosed embodiments, each of the polar expansions comprises at least a couple of metal plates independently mounted on each lateral main side of the arc chute.

In accordance with at least some disclosed embodiments, each of the further polar expansions comprises at least a couple of plates corresponding to the plates of the external polar expansions linked to the arc chute.

In accordance with at least some disclosed embodiments, each metal plate is substantially squared and is fixed to the synthetic plastic structure of the arc chute by fixing pins provided at the plate corners.

In accordance with at least some disclosed embodiments, the further polar expansions are overlapped by the external polar expansions.

It should be noted that the couple of plates of the further polar expansions are installed in a position that is more internal toward the intermediate switching portion while the plates of the external polar expansions are linked to the arc chute partially overlapping the corresponding further couple of plates establishing also an electrical contact.

Moreover, the partial overlapping of the corresponding plates allows establishing a sliding abutting contact providing an electrical conductivity between the plates.

A plurality of metal plates of different shape and size are associated to both sides of the arc chute as external polar expansions.

The couple of metal plates of the further polar expansion are provided on both sides of the breaker in correspondence of the dissipation coils provided in the proximity of the intermediate switching or breaking contacts portion.

The intermediate switching or breaking contacts portion may include auxiliary fixed and movable arcing contacts associated to respective arc runners electrically connected to respective dissipation coils provided for dissipating the electric arc formed during the opening phase of the movable arcing contacts; the couple of metal plates of the further polar expansion being provided on both sides of the breaker in correspondence of the dissipation coils.

Further coils may be placed like a belt on each external polar expansion in order to completely extinguish the electric arc generated in the arcing chamber keeping it inside the arc chute; the further coil being inserted in an insulated case made of synthetic plastic material.

Moreover, it must be noted that the casing of the breaker may comprise intermediate delimiting portions provided on both sides of the casing to delimit laterally the intermediate switching contacts portion and to provide lateral guides for the arc chute extinguishing portion, with the arc chute extinguishing portion being slidably mounted between the delimiting portions and with at least a lever mechanism extended transversally between the opposite intermediate delimiting portions for moving or raising the arc chute in case of an inspection.

In accordance with at least some disclosed embodiments, the plates are fixed to the arc chute and are movable with the arc chute when it is slidably moved by the lever for allowing the inspection of the covered breaking portion.

The polar expansions may be structured by a double group of metal plates, one associated to the intermediate switching or breaking contacts portion and the other associated to the arc chute and establishing a sliding electric contact between them.

With this understanding of the technical utility of the disclosed embodiments in mind, in the drawings figures, 1 is globally and schematically shown a breaker realized according to the disclosed embodiments.

In the following description we will disclose as a preferred embodiment the structure of a high speed circuit breaker that is taken in consideration as example of a breaker.

However, a skilled in the art understands that the principle of the disclosed embodiments may be applied also to a contactor device for high current switching applications, in particular industrial or railways applications wherein a high D.C. current must be switched on and off.

Let's now consider the breaker 1 which has substantially a squared parallelepiped shape with a bottom and top portion, two main sides and two sides of thickness.

The breaker 1 is specifically provided for industrial or railways applications wherein a high D.C. current must be interrupted with high efficiency and extremely fast intervention times.

For instance, the breaker 1 of disclosed embodiments is structured to be used on electrical equipment working in presence of severe over-current or over-voltages or short circuits that may occurs in substations of the metro line.

However, nothing refrains from employing this kind of breaker 1 in all the applications wherein a high D.C. current must be interrupted as quick as possible, for instance in a train station, on board of a train or in an industrial plant.

Just to give an idea of the working conditions and the range of current values involved for these kind of contactors, it should be noted that these devices must be able to efficiently interrupt currents at least up to 8000 ADC and under operating voltage values up to 4200 VDC.

Those operating values may even be referred to a single pole of the breaker. In many application it is however necessary to provide a double pole configuration and/or a three poles configuration.

In this respect, the breaker 1 of disclosed embodiments has a modular structure concerning a single pole configuration that is shown in the Figures but may be doubled or provided in a two or three poles configuration including two or three parallel modules according to the user's needs.

Moreover, the modularity of the breaker is maintained even for different voltage or current values in the sense that the device keeps the same external dimensions and size thanks to a specific structure of the arc chute.

In the following lines we will disclose just the structure of the single pole module.

The breaker 1 is structured with a base portion 2, supporting an activating mechanism 3, an upper or intermediate switching contacts portion 4, including fixed contacts 5 and movable contacts 6, and an arc chute extinguishing portion 7.

The electrical switching contacts form the breaking portion of the device while the arc extinguishing portion 7 is provided to cover and/or protect the electrical switching contacts.

In the more common vertical employment the base portion 2 is the bottom portion of the breaker and the arc chute extinguishing portion 7 is the top portion; however, the breaker 1 according to disclosed embodiments may even be installed in a horizontal position so that one of the main sides would be the bottom portion while the base 2 and the top part (made by ceramic) of the arc chute extinguishing portion 7 would be the lateral sides.

The structure of all the above mentioned portions will be disclosed hereinafter.

The single pole module of the breaker 1 presents a casing 10 covering from both lateral sides the base portion 2 and partially the switching contacts portion 4.

As above mentioned, the base portion 2 must be considered just as a delimiting wall of the casing 10 and not necessarily a bottom base since the whole breaker 1 may be installed with a vertical extension but may also be installed horizontally according to the user's needs.

In the annexed drawings, the breaker 1 is shown in a vertical position with the base portion 2 extended horizontally and associated with squared supporting flanges 21 for fixing the breaker to a support basement (not shown). However, nothing prevents from installing the breaker 1 extended horizontally; in such a case the base portion 2 would be extended vertically.

The casing 10 includes a synthetic plastic material structure having a predetermined isolation coefficient. Such a casing 10 comprises a pair of protection walls 11 covering from both main sides the breaker base portion 2 and the intermediate switching contacts portion 4, leaving open just a central opening 12. This protection wall 11 allows a better and more efficient isolation than the isolation offered by the air.

Such an opening 12 is provided for a quick lateral inspection.

Opposite intermediate delimiting portions 16, 18 are provided in the casing 10 to delimit laterally the intermediate switching contacts portion 4. These delimiting portions 16, 18 represent also two lateral guides for the arc chute extinguishing portion 7.

Advantageously, the arc chute extinguishing portion 7 is slidably mounted in the casing 10 between the above-mentioned opposite intermediate delimiting portions 16 and 18.

More particularly, one portion 16 is structured with a first part 17 or portion that we may consider closer to the switching contacts portion 4 and a second part 19 laterally embracing the arc chute extinguishing portion 7.

The first and second parts 17, 19 are integrally formed by a synthetic plastic material.

The first part 17 is thicker than the second part 19 and hosts a hinge 23.

Similarly, but with a slightly different structure, the other delimiting portion 18 includes a first part 27 or portion that is closer to the switching contacts portion 4 and a second part 29 laterally embracing the arc chute extinguishing portion 7. Even in this case the first and second parts 27, 29 are integrally formed by a synthetic plastic material.

The first part 27 is thicker than the second part 29 and hosts a slot 28, which is extended substantially parallel with outside lateral surface of casing 10 or the arc chute extinguishing portion 7.

A lever 25 has one end 25A hingedly attached to the hinge 23 of the first part 17 of the delimiting portion 16.

The lever 25 is extended transversally between the two opposite intermediate delimiting portions 16 and 18 and parallel to the protection walls 11 covering the breaker 1.

The lever 25 has an opposite end 25B that is slidably engaged into the slot 28 provided in the first part of the other delimiting portion 18 through a pin 30.

Figure 2:
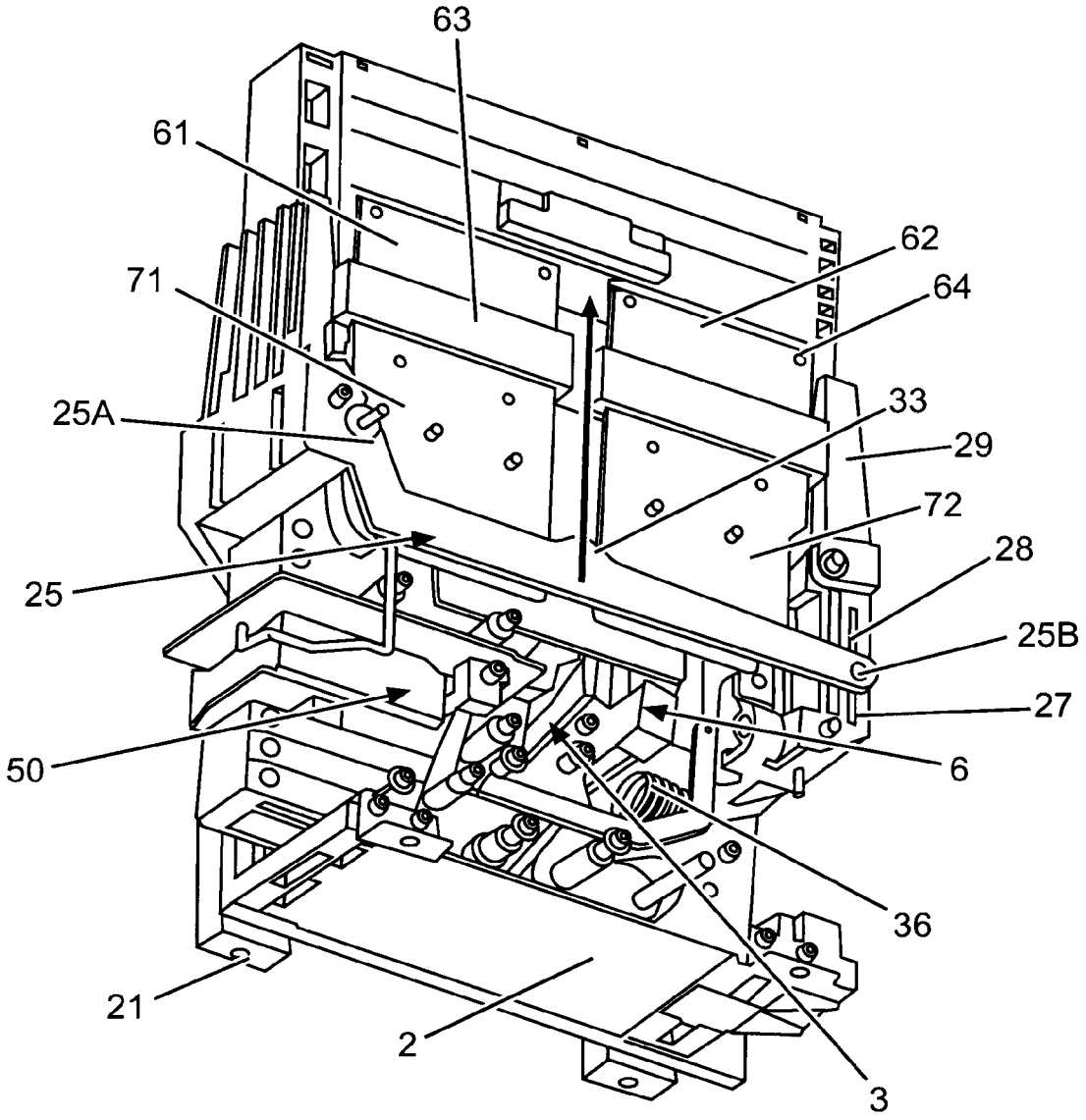
FIG. 2 shows a schematic and perspective view of the breaker of FIG. 1 with a lateral cover removed.
Figure 3:
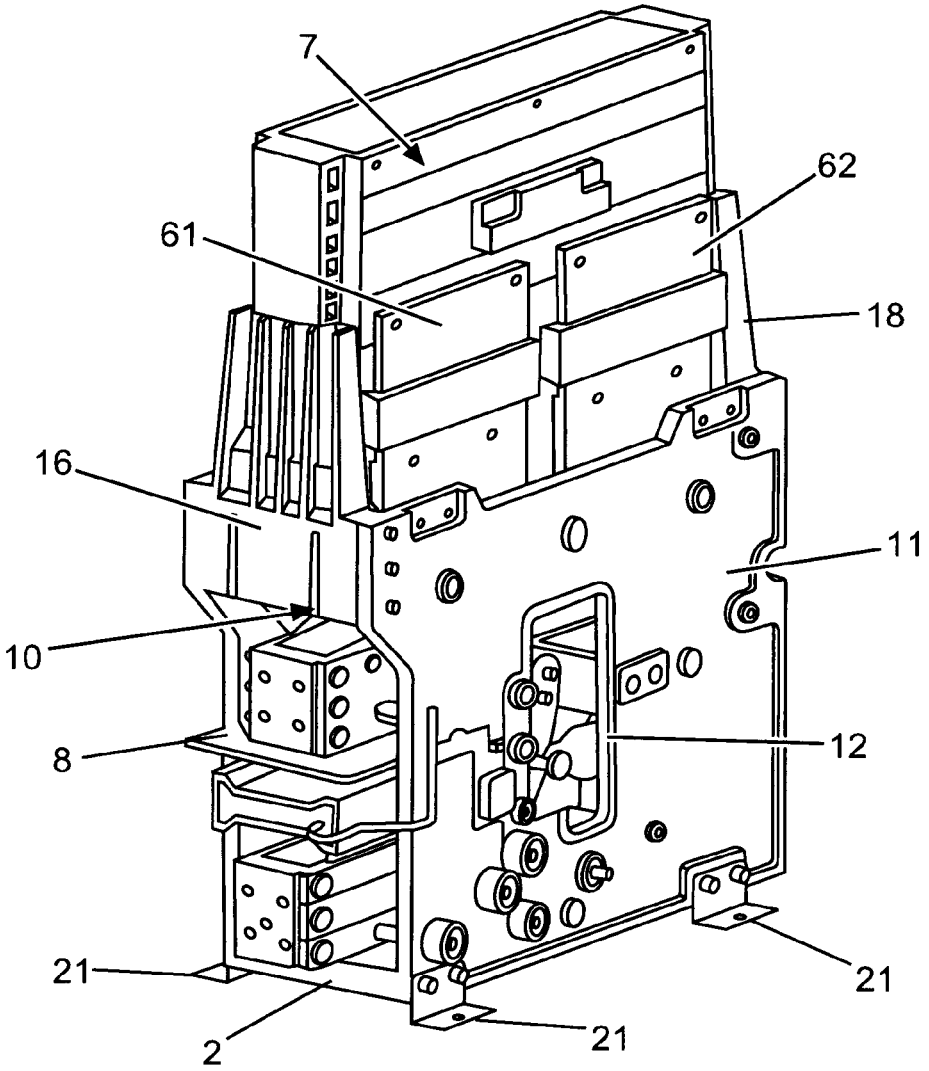
FIG. 3 shows a schematic and perspective view of the breaker of the disclosed embodiments shown from another point of view with respect to FIG. 1.
Figure 4:
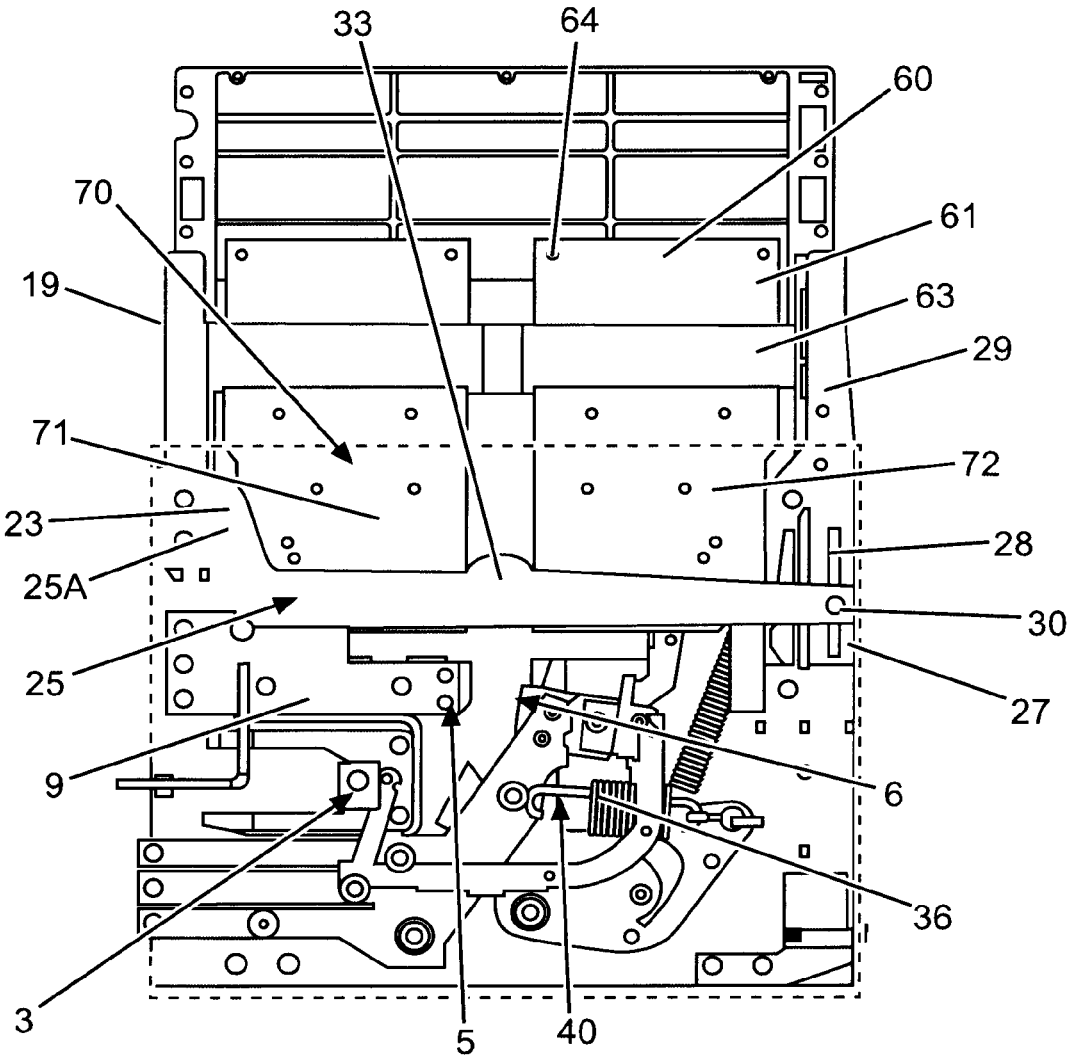
FIG. 4 shows a schematic and front view of the breaker of FIG. 3 with a lateral cover removed.

The structure shown in FIG. 2 shows the lever 25 at one main side of the breaker 1 while the structure shown in FIG. 4 shows the other lever at the other main side of the breaker 1. The provision of the levers 25 is symmetrical to allow a smoother sliding action on the arc chute extinguishing portion 7, as disclosed hereinafter.

Each lever 25 on both sides of the breaker 1 has a central enlarged portion 33 provided with a pin 32 projecting perpendicularly from each lever 25 toward the internal part of the breaker and acting on a corresponding lower edge 35 of the arc chute extinguishing portion 7.

A mechanism including a newer ending screw is provided for action on both levers 25. The never ending screw is hosted inside the delimiting portion 18 of the arc chute and has one end provided with a block linked to hinged end 25B of both levers 25 inside the first part 27 of the delimiting portion 18. The screw and its end block are not visible in the drawing being hidden inside the delimiting portion 18.

Once the pair of levers 25 is activated by the never ending screw hosted inside the delimiting portion 18 of the arc chute; each respective hinged end 25A of the levers 25 is pivotally angularly moveable around the hinge 23 while the opposite ends 25B are allowed to slide inside the slot 28.

This movement provides for the further movement of the central enlarged portion 33 of the lever 25 that pushes the pin 32 in the direction of the arrow F thus allowing the arc chute extinguishing portion 7 to be moved in a sliding manner away from the intermediate switching contacts portion 4.

As alternative, the breaker 1 of disclosed embodiments may be structured in a horizontal version with a sort of an insulating supporting tray. In such a case the never ending screw is provided on screwing supports fixed to such a tray. One end of the screw is directly coupled to the central enlarged portion 33 of the levers 25 in such a manner that the sliding movement of the end of the never ending screw acts directly of the central portion 33 of the levers 25.

In both vertical and horizontal versions the action of the never ending screw mechanism allows to move the arc chute extinguishing portion 7 both in the vertical or in the horizontal position of the breaker 1, according to the way it has been installed, without the use of a special crane or similar devices foreseen by the prior art for raising and handling the heavy arc chute.

In both versions, the action of the moving mechanism is performed symmetrically on both levers 25 supported on both sides of the breakers 1 and allows a smooth movement of the arc chute extinguishing portion 7 along the guides represented by the opposite intermediate delimiting portions 16, 18.

Figure 5:
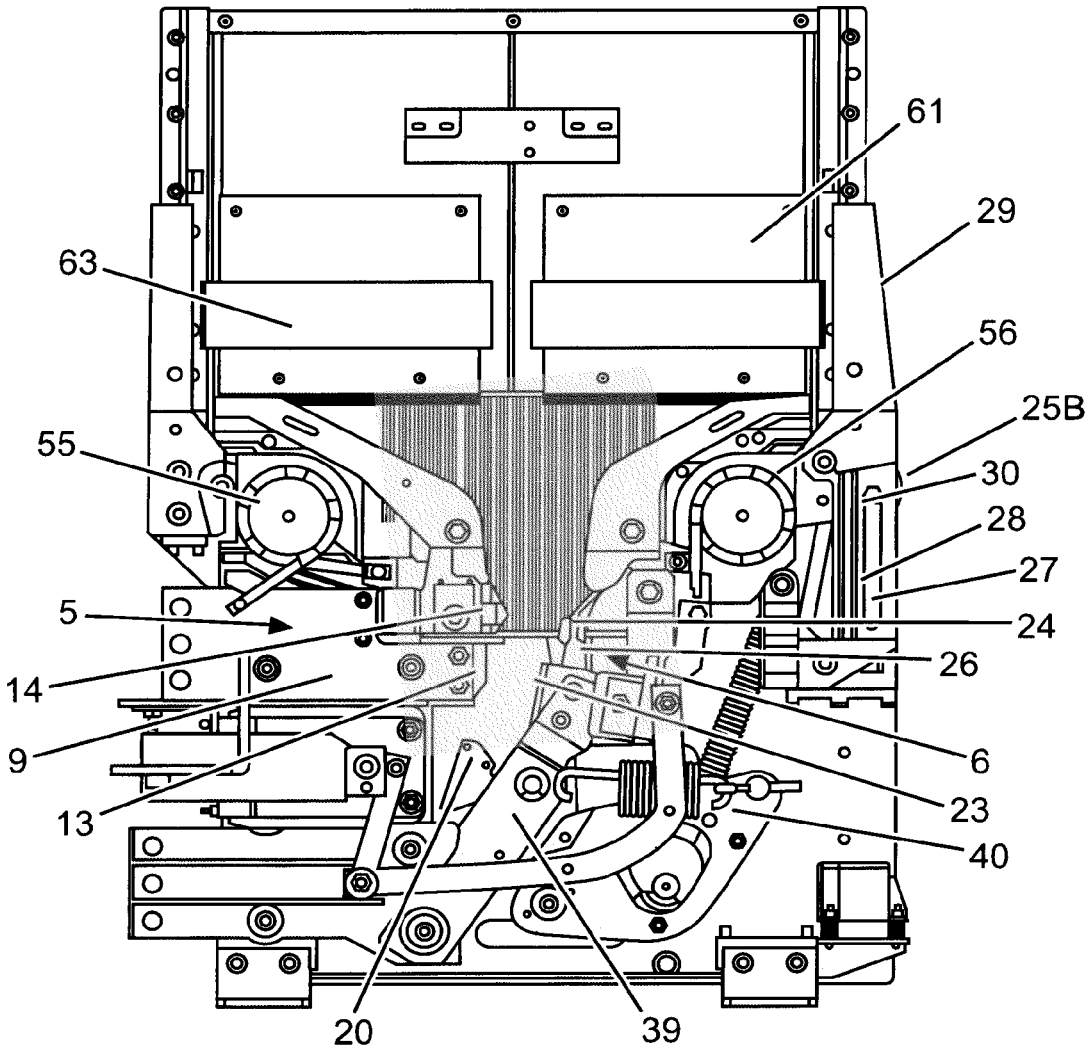
FIG. 5 shows a schematic view of an intermediate switching portion of the breaker device of the disclosed embodiments.
Figure 6:
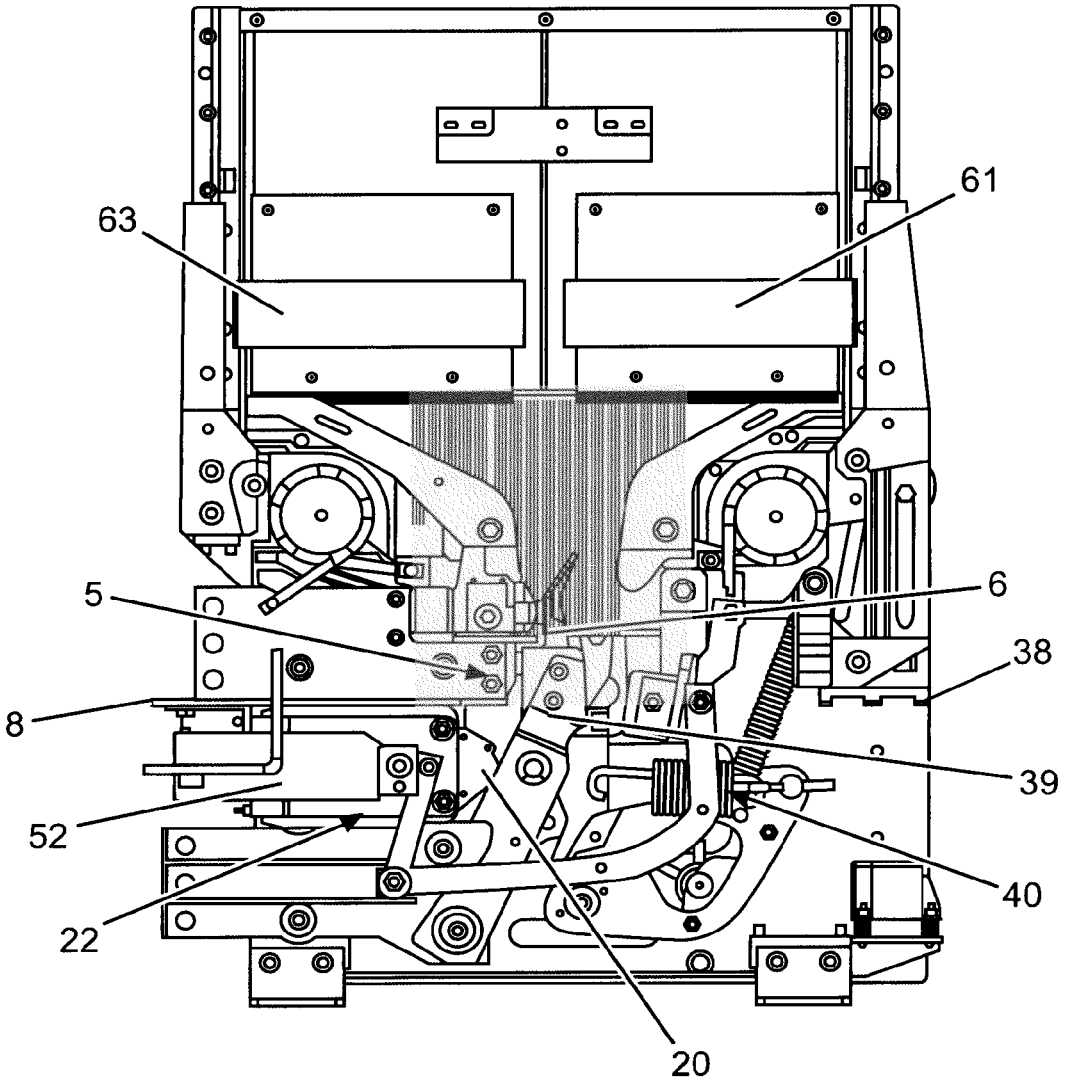
FIG. 6 is a schematic view of particulars of the switching portion of FIG. 5 under different operation conditions.
Figure 7:
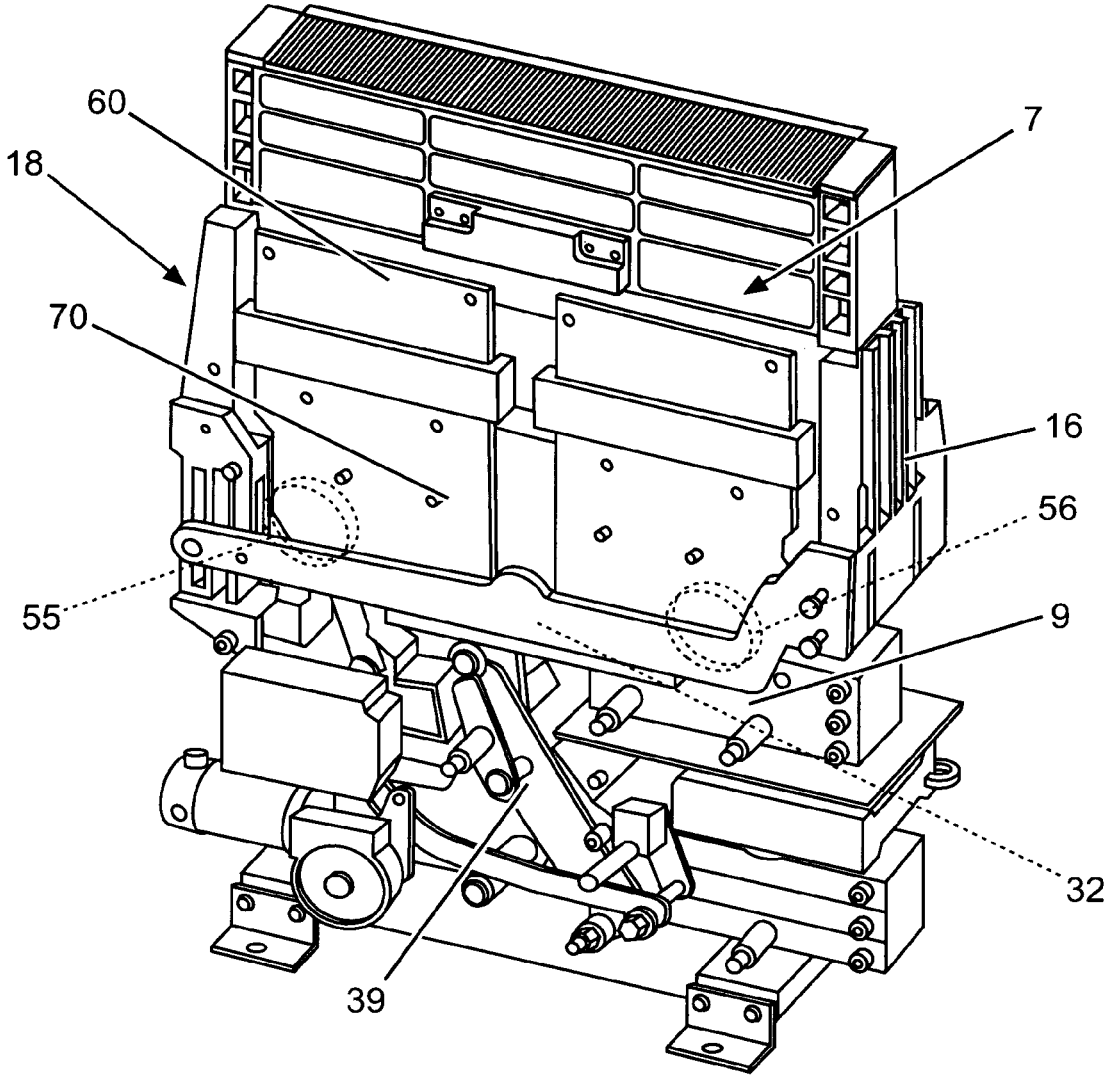
FIG. 7 shows a schematic and perspective view of the internal portion of the breaker of the disclosed embodiments.
Figure 8:
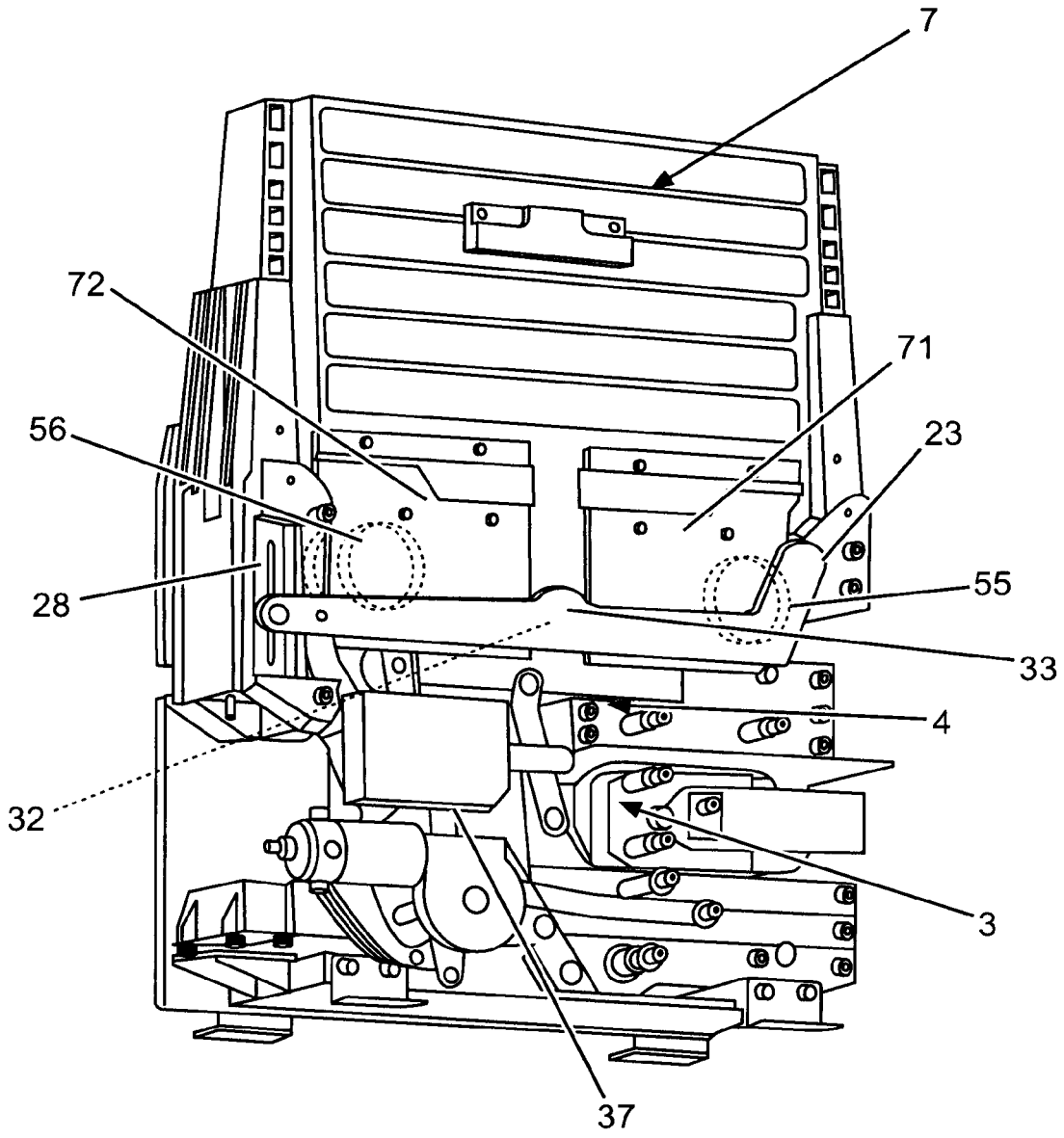
FIG. 8 shows a schematic and perspective view of the same internal portion of the breaker of FIG. 7 but taken from a different point of view.

Coming now to the intermediate switching contacts portion 4, the internal schematic structure of the breaking portion including the electrical switching means of disclosed embodiments is shown in FIGS. 5 and 6.

The breaking portion may be considered separated in a lower low voltage portion including the activating mechanism 3 and in an upper high voltage portion.

The low voltage portion is specifically provided for activating the breaking action of the upper high voltage portion.

The breaker 1 of disclosed embodiments may be considered a switching element that is provided with normally closed contacts that must open as fast possible in case of a short circuit or overcurrent situation according to the user's needs.

In this respect, according to disclosed embodiments, the breaking portion includes fixed contacts 5 and movable contacts 6.

It should be noted that the fixed power contacts 5 are structured with double contacts 13, 14 formed by different conductive materials.

A first fixed main contact 13 is supported internally on a fixed block 9 in a position that we may define closer to the activating mechanism 3.

Such a first fixed main contact 13 is formed by a very conductive silver alloy.

A second fixed arc contact 14 is supported on the same block 9 at a predetermined distance from the first fixed contact 13. We may also define this second contact 14 as an auxiliary arcing contact.

This second arcing contact 14 is formed by an alloy including tungsten.

The block 9 is connected to a first terminal power contact 8 projecting laterally outside the casing 10.

A movable rod 39 supports the movable contacts 6 which are similarly structured with double contacts 23, 24, a main contact 23 and an auxiliary arcing contact 24, formed by different conductive materials. However, according to the disclosed embodiments, an elastic element 26 is structurally interposed between the contacts 23 and 24 of the movable rod 39.

The presence of this elastic element 26 allows a slight imbalance of the upper auxiliary arcing contact 24 toward the corresponding fixed auxiliary arcing contact 14, so that the upper movable contact 24 may touch first the corresponding fixed contact 14 during the closure phase of the breaker 1.

The movable rod 39 is angularly moveable from a rest or open position to an operative or closed position wherein the movable contact 6 is abutting against the fixed contacts 5. The movement of the rod 39 supporting the movable contacts 6 toward the fixed contacts 5 charges the elastic force of elastic means 40 constantly biased toward the opening of the contacts.

Also, the rod 39 is connected to a second terminal power contact 38 projecting laterally outside the casing 10 from the opposite side with respect to the other terminal 8.

It is interesting to note that, according to disclosed embodiments, angular movement of the second rod 39 with the pair of contacts 23, 24 toward and away the fixed contacts 13, 14 of the fixed block 9 are obtained in two operations.

First of all the angular movement allows a first contact between the upper contacts 14 and 24 closer to the arc chute extinguishing portion 7 and immediately after intervenes a second contact between the lower contacts 13 and 23 closer to the activating mechanism 3.

Once the mobile contacts 23, 24 are abutting against the fixed contacts 13, 14, the breaker is kept in such a closure position by the magnetic attraction exerted by a coil 22 supported under the fixed contact 5 and supplied by an auxiliary current. The magnetic force of the coil 22 is directed toward an anchorage element 20 of the movable rod 39.

The contact between the coil 22 and the anchorage element 20 happens during the closure phase but before the main contacts 13, 23 get in touch one with the other, therefore before the effective closure of the power electric circuit.

During the opening phase two different situations may happen:

The current circulating inside the coil 22 is reduced to zero cutting the auxiliary supply. In such a case the only force acting on the breaker is exerted by the elastic means forcing the opening of the breaker.

During a possible short circuit or an overvoltage inside the coil 22 produces an extra current that reaches a predetermined threshold.

Such an extra current reduces to zero the magnetic field keeping the anchorage element 20 abutting against the coil and leaving the elastic means 40 to release their elastic energy thus opening the breaker.

During the opening phase, the main and lower contacts 13 and 23 are separated first and immediately after intervenes the separation between the secondary upper contacts 14 and 24.

This double operation movement allows a first reduction of the possible electric arch that is normally generated between the fixed and movable contacts during the opening phase of a breaker for so high currents or voltages.

As previously disclosed with reference to the situations 1 or 2, it is also important to note that the movable contacts 6 are activated by the release of elastic means 40 constantly biased toward the opening of the contacts.

Those elastic means 40 are structured with a pair of springs 36, 37 that are extended when the breaker 1 is in the closure configuration.

One end of each the springs 36, 37 is connected to the movable rod 39 while the opposite end is linked to a fixed part of the breaker structure.

In other words, when the movable contacts 6 are in contact with the fixed contacts 5 the elastic means 40 are solicited so that the springs 36, 37 are charged. In this manner the release of the springs depends from the elastic constant K but not from the operating voltage value of the breaker.

Differently from the known solutions, the breaking action of the breaker 1 does not depend from a coil that is charged to keep a closure position and therefore does not depend from a voltage value applied to the coil.

This breaking structure allows obtaining faster separation of the movable contacts from the fixed contact and a faster intervention of the breaker.

Moreover, energy savings are obtained during the normal operating conditions since the breaking action of the breaker 1 is not subject to electric supply.

The closure of the movable contacts is performed by engine means 50 that are electrically supplied by a chopper 52, that is to say a breaker that converts fixed DC input to a variable DC output voltage directly. In other words, as referred with reference to the supply of the coil 20 used for keeping the closure of the contacts 5, 6, an auxiliary supply is provided for the breaker 1 and a voltage conversion is provided by a converter circuit. For instance, a multi-voltage converter circuit is provided for supplying the breaker with a 24V voltage supply while the user provides a basic 1 10 V voltage supply.

The closure phase is performed in about two seconds according to the voltage value of the circuit wherein the breaker is installed.

The performances of the breaker according to disclosed embodiments are also due to the specific structure of the arc chute component.

The arc chute extinguishing portion 7 may be structurally different according to the different voltage ranges that must be treated and the corresponding arc chute type and energy capacity that shall be extinguished in total security.

However, the arc chute extinguishing portion 7 of disclosed embodiments is provided with external polar expansions 60 that are coupled on both main sides of the breaker 1.

More specifically, a pair of metal plates 61, 62 are independently mounted on each lateral main side of the arc chute extinguishing portion 7.

Each plate 61, 62 is substantially squared and is fixed to the synthetic plastic structure of the arc chute by fixing pins 64 provided at the plate corners.

Moreover, further coils are placed like a belt 63 on each external polar expansion in order to manage correctly the movement of the electric arc inside the arcing chamber and to hold it inside the arc chute during the extinguish phenomenon. Each coil is inserted in an insulated case made of synthetic plastic material to isolate and protect it from external devices or adjacent breaker module.

A skilled in the art would understand that a different number of plates, or a single plate or plates of different shape and size may be adopted as external polar expansions on both sides of the arc chute extinguishing portion 7.

It must be remarked that the plates 61, 62 are fixed to the arc chute, and are, therefore, movable with the arc chute when it is slidably moved by the lever 25 for allowing the inspection of the covered breaking portion.

However, according to the disclosed embodiments, the external polar expansion 60 are electrically coupled to further corresponding polar expansions 70 that are linked to the fixed part of the breaker 1 that is to say the intermediate switching portion 4.

These further polar expansions 70 are still keep externally with respect to the internal structure of the breaker and are overlapped by the previously disclosed polar expansions 60.

More specifically, even the further polar expansions 70 comprise a pair of plates 71, 72 that are similar in shape and size to the corresponding plates 61, 62 of the polar expansions 60 linked to the arc chute.

Even the plates 71, 72 are provided on both main sides of the breaker 1.

The plates 71, 72 are structurally independent from the corresponding plates 61 and 62.

Over the auxiliary arcing contacts 14 and 24, but still in the intermediate switching portion, respective arc runners (not shown) are provided.

Those arc runners help dissipating the electric arc formed during the opening phase of the moving contacts 23, 24. More particularly, each of the arc runners is electrically connected to respective dissipation coils 55, 56 provided at the shoulder of each fixed or movable contact 5 or 6.

The metal plates 71, 72 of the polar expansion 70 are provided on both sides of the breaker 1 in correspondence of the end portions of the core inserted inside the dissipation coils 55, 56 respectively.

All the figures clearly show these metal plates 71, 72 at one side of the breaker but it should be considered also the presence of the corresponding plate situated in a parallel position on the other side of the breaker.

The plates 71, 72 of the polar expansion 70 are installed in a position that is more internal toward the intermediate switching portion 4 while the plates 61, 62 of the other external polar expansion 60 are linked to the arc chute partially overlapping the corresponding plates 71, 72 establishing also an electrical contact.

In other words the partial overlapping of the plates allows establishing a sliding abutting contact providing an electrical connection to guarantee the electrical conductivity between the plates 61, 71 and 62, 72.

In this manner a larger polar expansion structure is provided in order to offer a greater extinguishing capability for the breaker according to the disclosed embodiments.

Moreover, the fact that the polar expansion are structured by a double group of metal plates, one associated to the breaker and the other associated to the arc chute, allows reducing the weight of the arc chute extinguishing portion 7. This is a further advantage since the arc chute of disclosed embodiments may be raised or slidably moved by the lever mechanism 25 and a weight reduction facilitates this displacement during the inspection activities.

Coming back just for a while to the activating mechanism 3 it should be noted that such a mechanism includes a low voltage driving portion with means to keep closed the breaking contacts. The activating mechanism is structured in a conventional manner to automatically activate the opening of the movable contacts 6 of the breaker when an overcurrent condition is sensed.

These means may be identified as a trip unit that is the part of the circuit breaker 1 that determines when the contacts 6 must open automatically. As previously disclosed, during a possible short circuit or an overvoltage inside the coil 22 an extra current is generated and this extra current overcoming a predetermid threshold reduces to zero the magnetic field keeping the anchorage element 20 abutting against the coil and leaving the elastic means 40 to release their elastic energy thus opening the breaker 1.

In a thermal-magnetic circuit breaker, the trip unit includes elements designed to sense the heat resulting from an overload condition and the high current resulting from a short circuit.

In view of the previous description it should be evident the functioning of the breaker device 1 of disclosed embodiments.

In the previous description the directional terms like: "forward", "rearward", "front", "rear", "up", "down", "above", "below", "upward", "downward", "top", "bottom", "side", "vertical", "horizontal", "perpendicular" and "transverse" as well as any other similar directional terms refer just to the device as shown in the drawings and do not relate to a possible use of the same device.

Accordingly, these directional terms, as utilized to describe the breaker in its upright vertical position or in a horizontal position have just the meaning to identify a portion of the device with respect to another portion as shown in the Figures.

The term "comprising" and its derivatives, as used herein, are intended to be open ended terms that specify the presence of the stated features, elements, components, groups, integers, and/or steps, but do not exclude the presence of other unstated features, elements, components, groups, integers and/or steps. This concept also applies to words of similar meaning, for example, the terms "have", "include" and their derivatives.

Moreover, the terms "member", "section", "portion", "part" and "element" when used in the singular can have the dual meaning of a single part or a plurality of parts.

The invention claimed is:

1. A breaker for high current or voltage applications for switching or interrupting a high current on/off with high efficiency and fast intervention times, in industrial and/or railways applications the breaker comprising:

a casing;

a base portion in the casing, the base portion supporting:

an activating mechanism for switching means including a holding mechanism and a release mechanism;

an intermediate switching or breaking contact portion, including fixed contacts and movable contacts, and a top arc chute extinguishing portion covering the intermediate switching or breaking contact portion, wherein:

the arc chute extinguishing portion is moveable with respect to the switching or breaking contact portion and is provided with external polar expansions that are coupled on both main sides of the breaker;

further polar expansions being electrically coupled to the external polar expansions and linked to the intermediate switching or breaking contact portion as fixed part of the breaker.

2. The breaker of claim 1, wherein each of the polar expansions comprise at least a pair of metal plates independently mounted on each main side of the arc chute extinguishing portion.

3. The breaker of claim 2, wherein each metal plate is substantially square and is fixed to a synthetic plastic structure of the arc chute extinguishing portion by fixing pins provided at plate corners.

4. The breaker of claim 2, wherein a plurality of metal plates of different shapes and sizes are associated to both sides of the arc chute extinguishing portion as external polar expansions.

5. The breaker of claim 1, wherein each of the further polar expansions comprises at least a pair of plates corresponding to the plates of the external polar expansions linked to the arc chute extinguishing portion.

6. The breaker of claim 5, wherein the pair of plates of the further polar expansions are installed at a position that is more internal toward the intermediate switching or breaking contact portion than the external polar expansion, while the plates of the external polar expansions are linked to the arc chute extinguishing portion partially overlapping the corresponding further pair of plates establishing also an electrical contact.

7. The breaker of claim 6, wherein the partial overlapping of the corresponding plates allows establishing a sliding abutting contact providing an electrical conductivity between the plates.

8. The breaker of claim 5, wherein the pair of metal plates of the further polar expansion are provided on both sides of the breaker in correspondence to dissipation coils provided in proximity of the intermediate switching or breaking contact portion.

9. The breaker of claim 5, wherein the intermediate switching or breaking contact portion includes auxiliary fixed and movable arcing contacts associated to respective arc runners electrically connected to respective dissipation coils provided for dissipating an electric arc formed during an opening phase of said movable arcing contacts, the pair of metal plates of the further polar expansion being provided on both sides of the breaker in correspondence to said dissipation coils.

10. The breaker of claim 9, wherein further coils are placed in a belt on each external polar expansion to completely extinguish the electric arc generated in an arcing chamber keeping the arc inside the arc chute extinguishing portion, wherein the further coil is inserted in an insulated case made of a synthetic plastic material.

11. The breaker of claim 1, wherein the further polar expansions are overlapped by the external polar expansions.

12. The breaker of claim 1, wherein the casing comprises intermediate delimiting portions provided on both lateral sides of the casing to delimit laterally the intermediate switching or breaking contact portion and to provide lateral guides for the arc chute extinguishing portion;

the arc chute extinguishing portion being slidably mounted between the delimiting portions;

at least a lever extends transversally between opposite intermediate delimiting portions for moving or raising the arc chute extinguishing portion in case of an inspection.

13. The breaker of claim 12, wherein the plates of the external polar expansions are fixed to the arc chute extinguishing portion and are movable with the arc chute extinguishing portion when the arc chute extinguishing portion is slidably moved by the lever for allowing the inspection of a covered breaking portion.

14. The breaker of claim 1, wherein the external and further polar expansions are structured by a double group of metal plates, one associated to the intermediate switching or breaking contact portion and another associated to the arc chute extinguishing portion and establishing a sliding electric contact between the double group of metal plates.

* * * * *